US005295940A

United States Patent [19]

Fainberg

[11] Patent Number: 5,295,940

[45] Date of Patent: Mar. 22, 1994

[54] PAIL BOX MACHINERY

[76] Inventor: Abram Fainberg, 7 Roger Williams Green, Providence, R.I. 02904

[21] Appl. No.: 41,155

[22] Filed: Apr. 1, 1993

[51] Int. Cl.[5] ..... B31B 3/44; B31B 3/86; B21F 45/00; B21F 45/10

[52] U.S. Cl. ..... 493/88; 140/75

[58] Field of Search ..... 493/88, 125, 167, 174, 493/909; 140/75

[56] References Cited

U.S. PATENT DOCUMENTS

| | | | |
|---|---|---|---|
| 1,001,198 | 8/1911 | Haas | 493/88 |
| 1,038,145 | 9/1912 | Inman | 493/88 |
| 1,509,191 | 9/1924 | Craig | 493/88 |
| 1,509,192 | 9/1924 | Craig | 493/88 |
| 1,511,320 | 10/1924 | Craig | 493/88 |
| 2,623,274 | 12/1952 | Henchert | 140/75 |
| 3,441,065 | 4/1969 | Nerod | 140/75 |
| 3,877,135 | 4/1975 | Heisler | 140/75 |
| 5,123,888 | 6/1992 | Fainberg | 493/88 |
| 5,197,936 | 3/1993 | Fainberg | 493/88 |

FOREIGN PATENT DOCUMENTS

| | | | |
|---|---|---|---|
| 1696046 | 12/1991 | U.S.S.R. | 140/75 |

*Primary Examiner*—William E. Terrell

[57] ABSTRACT

Provided here is a novel construction for making and attaching wire handles to folded boxes from straight pieces of wire for both automatic pail box machines and vending cabinets. The mechanisms for making and attaching handles include: a container for containing wire blanks and feeding them only one piece per cycle, a bed die mechanism and reciprocated shuttle. The lead wire blank, which is fed from the container is placed on the receiver portion of the shuttle. At the same time from the bed die mechanism, a handle is pushed which has been made in the previous cycle. This handle is placed on the shipping portion of the shuttle. In its motion the shuttle attaches the made handle to the folded box and in cooperation with the bed die mechanism bends the lead wire blank to form a new handle. Thus, the process of each cycle includes fastening the made handle to the folded box and bending a new handle for fastening it in the next cycle. Permanent magnets are provided for holding the wire blank and the made handle in a suitable position during the making and the attaching of the handle.

4 Claims, 6 Drawing Sheets

PAIL BOX MACHINERY

CROSS REFERENCE TO RELATED APPLICATION

This application is related to U.S. application 07/697,254 filed May 8, 1991, now Pat. No. 5,123,888, issued Jun. 23, 1992.

BACKGROUND OF THE INVENTION

1. Field of the Invention

This invention relates to machinery for making paper board containers and, more particularly, to machines for making boxes with handles, preferably from wire.

2. Description of the Prior Art

A well known semi-automatic machine made by Saranac Co. produces boxes with handles made from a coil of wire. In this machine prepared blanks are automatically fed by conveyor. The machine then folds, forms, attaches wire handle from a wire coil, ejects, nests and counts the boxes. Finished boxes are delivered in packages of needed quantity to users. This method of producing boxes by machines of the Saranac type has a number of imperfections which have kept the pail box from wider use:

a. Pail boxes are more expensive relative to other types of boxes with the same purpose;

b. There are problems in automatically separating boxes one from another;

c. Boxes are subject to damage during transportation and storage;

d. Present machinery, designed for production of pail boxes in a factory, can't to be installed in an automatic production line for goods;

e. There are problems with advertising the users name and packing the box with goods.

In application 07/697,254 filed May 8, 1991 I presented a hand-operated and automatic machine for producing pail boxes from pre-made blanks of paper and pre-made wire handles bonded together in the form of a bar. Relative to the hand-operated machine with its small capacity, the pre-made handle bar allows successfully using the machine directly in restaurants, stores, small production companies, etc. But in the case of the automatic machine for continuously producing boxes the machine must be equipped with a mechanism for automatically feeding the handle bars. The other question is a packing problem because the fully made handles require more space for storage.

These disadvantages are overcome by the present invention in the matter of feeding the machine with blank handles which are accomplished by the use of a fully straight pieces of wire blanks.

SUMMARY OF THE INVENTION

Generally stated, the object of the invention is to provide a novel construction, whereby boxes with wire handles can be made in rapid and efficient manner on an automatic machine by using blanks of paper and straight pieces of wire blanks.

Another object of the invention is to provide a novel construction whereby boxes with wire handles can be automatically made inside of the vending cabinets for packing goods.

In accordance with the present invention the automatic machine and the vending cabinet each includes: a wire blank container two walls of which form a vertical gauged groove for arranging the moved down wire blanks in one row, a reciprocation shuttle transfers at the same time a following wire blank to the die for making the handle and a handle, made in the previous cycle for fastening it to the folded box, a number of pushers for moving, bending and fastening handles, a vibrator for providing in vibration condition the wire blanks container, and several permanent magnets for carry out the process of making and fastening handles to the folded box.

The mechanisms for selection and folding paper blanks for an automatic machine of the present invention are same as it mentioned in the Pat. No. 5,123,888 in section of "Automatic Pail Box Machine" and several of these mechanisms are used for vending cabinets.

In order that the invention and objects thereof may be readily understood and put into practice, reference will now be made to the various figures of the drawings in which.

DESCRIPTION OF THE PREFERRED EMBODIMENT

The automatic pail box machine is intended for use in an automatic production line for packing goods or for producing boxes for storage. The machine is intended to produce boxes from pre-made blanks of paper and straight pieces of wire. The machine includes fording means, blank storage assembly, means for intermitently feeding paper blanks to position for folding, receiver means for receiving made boxes to be packed with goods or for arranging boxes in batches of desired quantity for storage, and drive machine means. All of these mechanisms are approximately similar to mechanisms of the automatic machine disclosed in U.S. application 07/697,254 filed May 8, 1991, now Pat. No 5,123,888 issued Jun. 23, 1992 and are not described in detail in this specification.

The mechanisms and elements of the machine to which the improvement are directed includes (see FIG. 1): a wire blank container 20 for containing wire blanks and feeding the machine with one blank per cycle, a shuttle mechanism 50 for delivery at the same time of a handle made in the previous cycle for attaching it to the folded box and a following wire blank selected in the container 20 for making a new handle which will be attached in the next cycle, and a bed die means 60 for bending handles.

Figure 1:
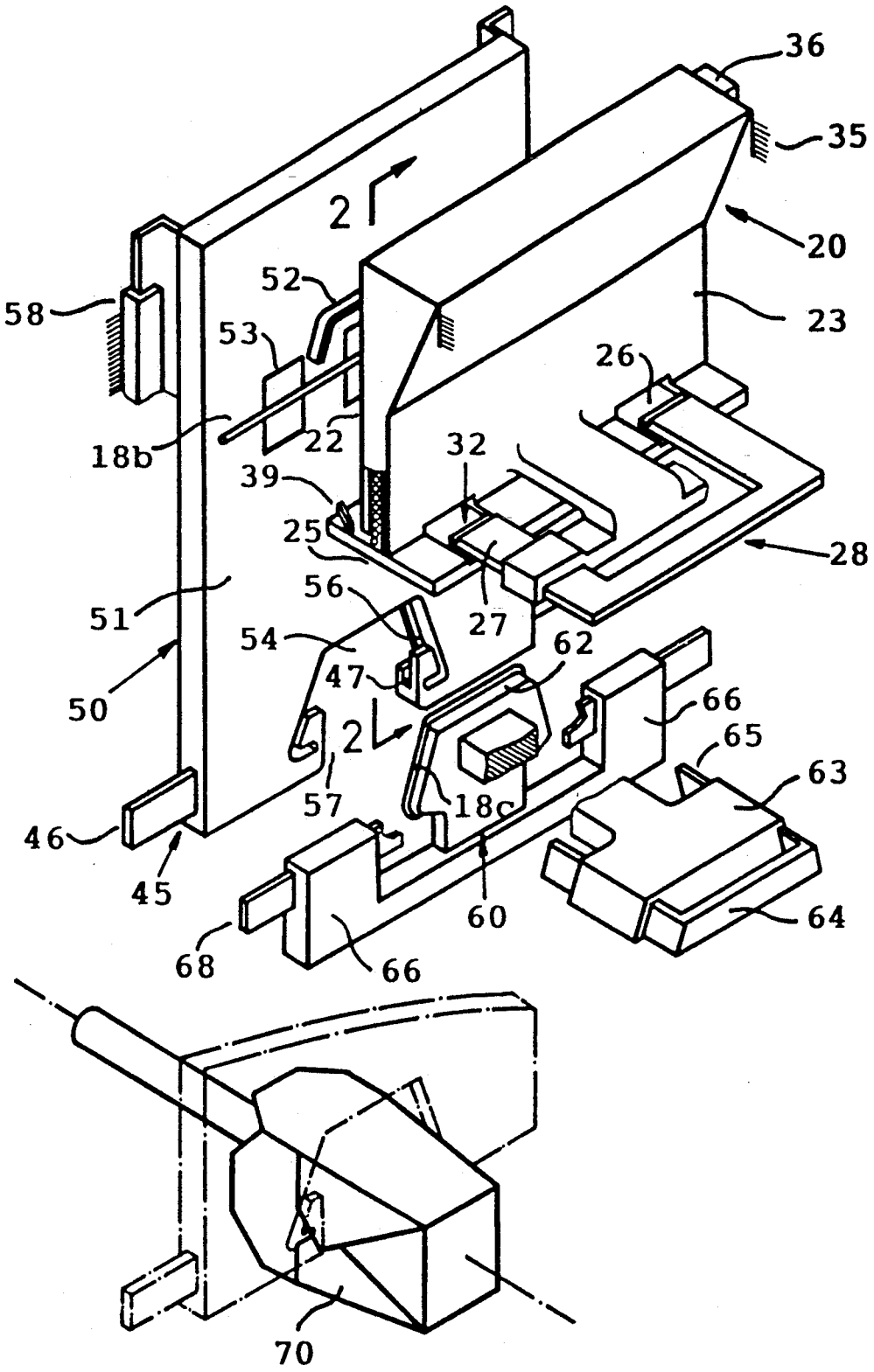
FIG. 1 is an exploded perspective view of the primary structure in accordance with the present invention.
Figure 2:
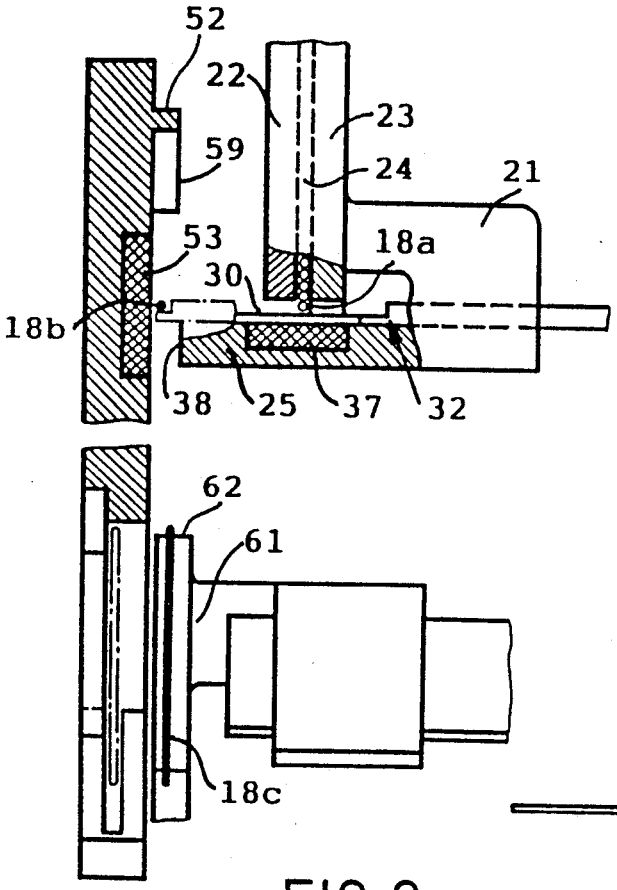
FIG. 2 is a sectional view taken along lines 2—2 of FIG. 1 showing the primary structure of the present invention when the shuttle is in upper position.
Figure 10:
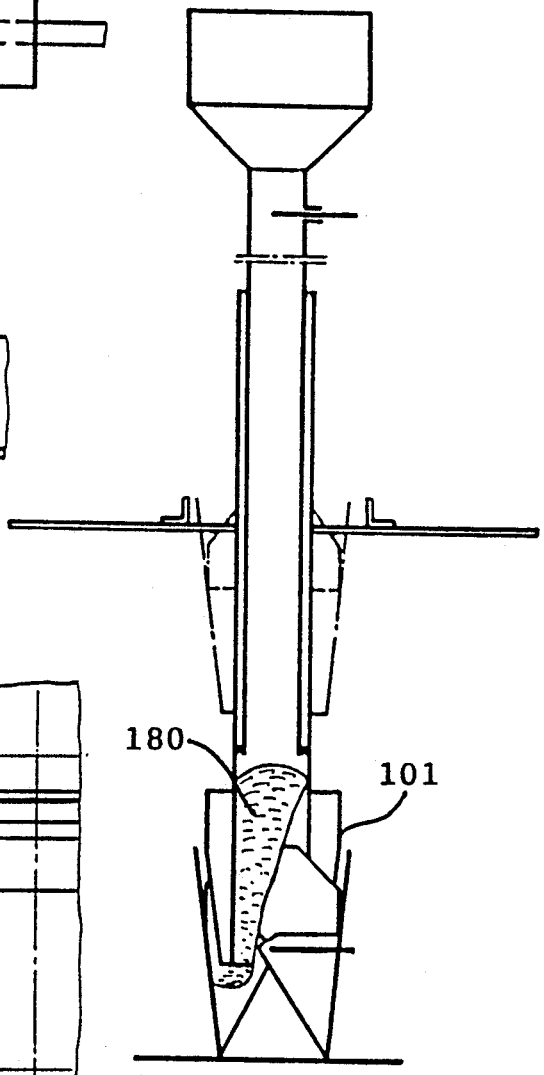
FIG. 10 is a fragmentary sectional view of the folding assembly where the piston is used for folding boxes and fillinf its with goods.
Figure 3:
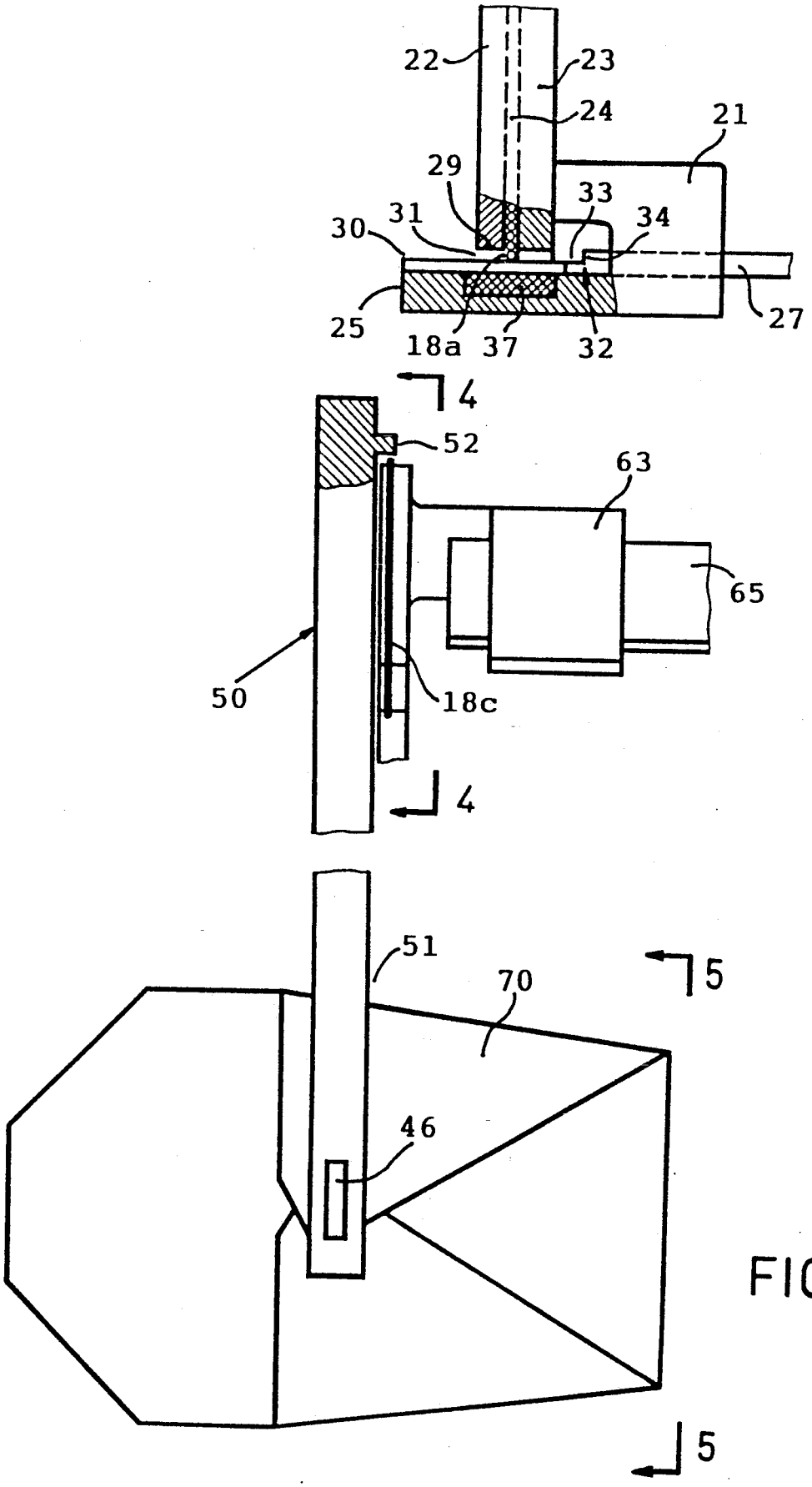
FIG. 3 is a fragmentary side elevation view with portions broken away showing the primary structure of the present invention when the shuttle is in bottom position.

As shown in FIGS. 1-3 the container 20 has two walls 22 and 23 which form a vertical gauged groove 24 for sliding down wire blanks just in one row. To the bottom of the container 20 perpendicular to its walls is rigidly attached plate 25 with two or more guide grooves 26 which are continued in the bracket 21 for sliding claws 27 of the pusher 28. The edge 29 of the wall 22 and the upper surface 30 of the plate 25 form a gauged outlet 31 through which can be pushed only one piece of wire blank per cycle. The end of the each claw 27 has a step 32 the surfaces 33 of which are at the same level as the upper surface 30 of the plate 25 and the height 34 of the step 32 is equal to the diameter of the wire handle. The container 20 is mounted to the frame of the machine by elastic suspensions 35 and is power operated by means of a vibrator 36. By vibration and gravity the wire blanks in the container 20 are moved down and fill the groove 24. For connecting the lead wire blank 18*a* on all its length with the upper surface 30, flush to the plate 25 permanent magnets 37 are inserted. Thus, when the pusher 28 is power operated its claws 27 pick up the lead wire blank 18*a* and push it through the outlet 31 in the direction of the shuttle 50. By the guide means 39, which are installed on the ends of the plate 25, the pushed on the shuttle wire blanks 18*b* are centered to arrange suitable position.

Figure 6:
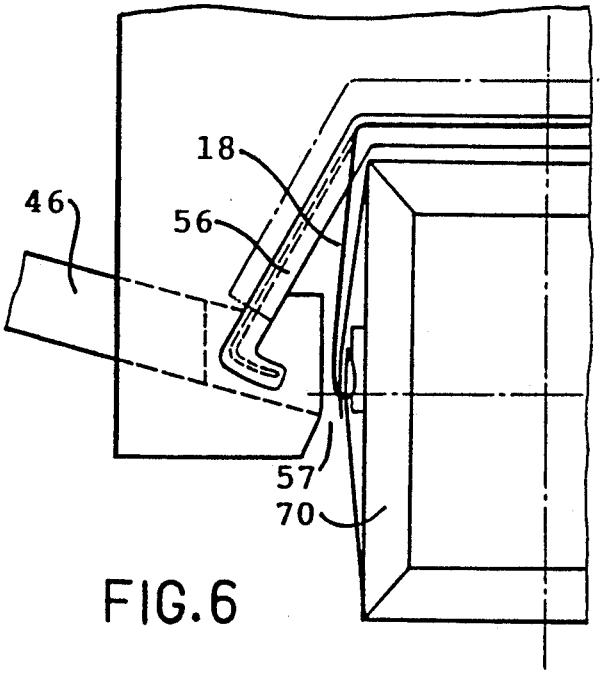
FIG. 6 is a progressive guide of the clinchers motion.

Conveyance of straight and bended blank handles in the machine is provided by the shuttle mechanism 50 which is reciprocated in guides 58 of the machine in the vertical plane. The base of the shuttle 50 is a plate means 51 on the receiver portion of which are located a forming punch 52 and permanent magnets 53 which are flushly inserted in the plate means 51. On the shipping portion of the plate 51 there are a hollow 54 for receiving made handles 18*c* from the bed die 60 and two clinching mechanisms 45 for fastening the handles to the folded boxes. Each clinching mechanism has a clincher 46, which is slids in a guide 47 of the plate means 51, and a return spring (not shown). The angle between the guides 58 and 47, in which the shuttle 50 and clinchers 46 slides, may be other than 90° as it's shown in FIG. 6. The hollow 54 has magnet edges 56 which hold the handle 18 in suitable position and an opening 57 through which is released the fastened handle when the shuttle is going up.

Figure 4:
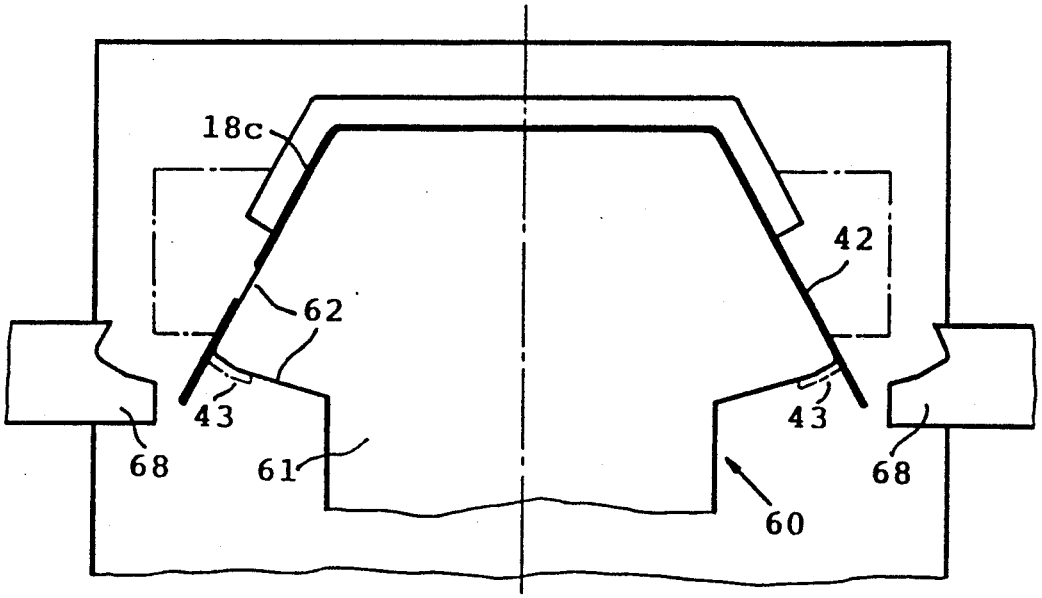
FIG. 4 is a fragmentary front view taken along lines 4—4 of FIG. 3 showing the bed die mechanism in position for bending handle.

As shown in FIGS. 1 and 4 the bed die means 60 includes a member 61 with shape 62 for bending handles, a front bracket 63 in which a pusher 64 with two claws 65 slides and two side brackets 66 in each of which a punch 68 slides. The shuttle 50 is located close to the container 20 and to the bed die means 60. The clearance between the plate means 51 and the member 61 and between the edges 38 and 59 are within sliding fits for passing the shuttle through.

As mentioned in the description of the previous U.S application 07/697,254 filed May 8, 1991 the machine is intended to be driven continuously, and therefore most movable parts of the machine move in timed or synchronized relationship which may be obtained by means of any conventional driving and synchronizing mechanisms well known in the art, and therefore not described in detail in this specification.

Figure 5:
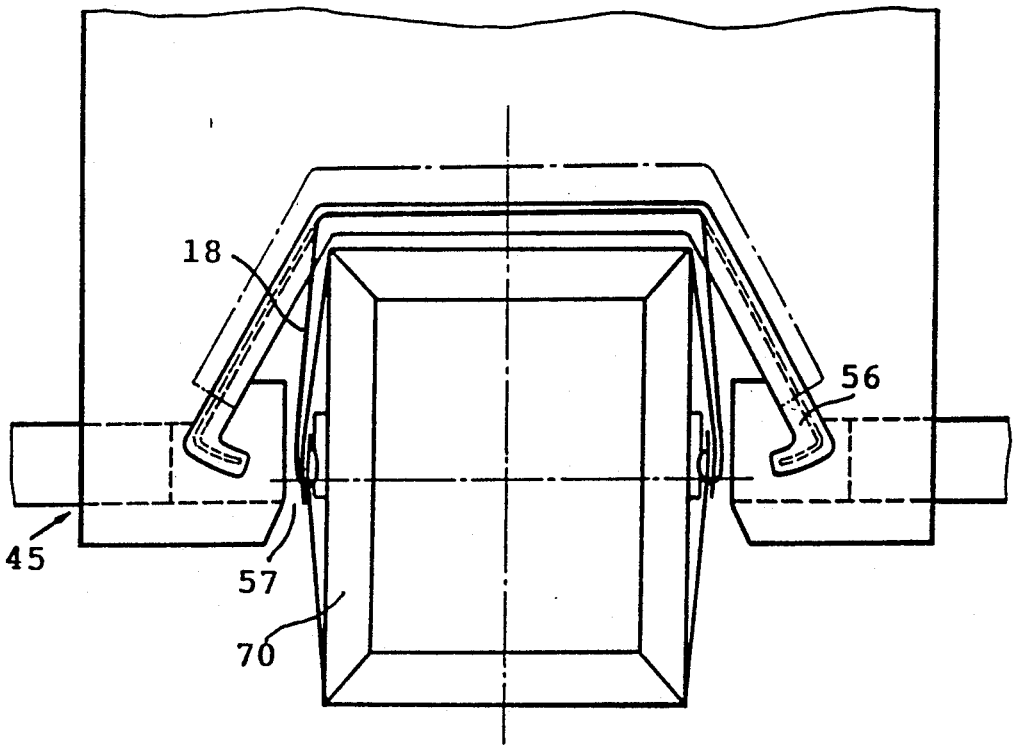
FIG. 5 is a fragmentary front view taken along lines 5—5 of FIG. 3 showing the shuttle mechanism in position for attaching handle to the folded box.
Figure 7:
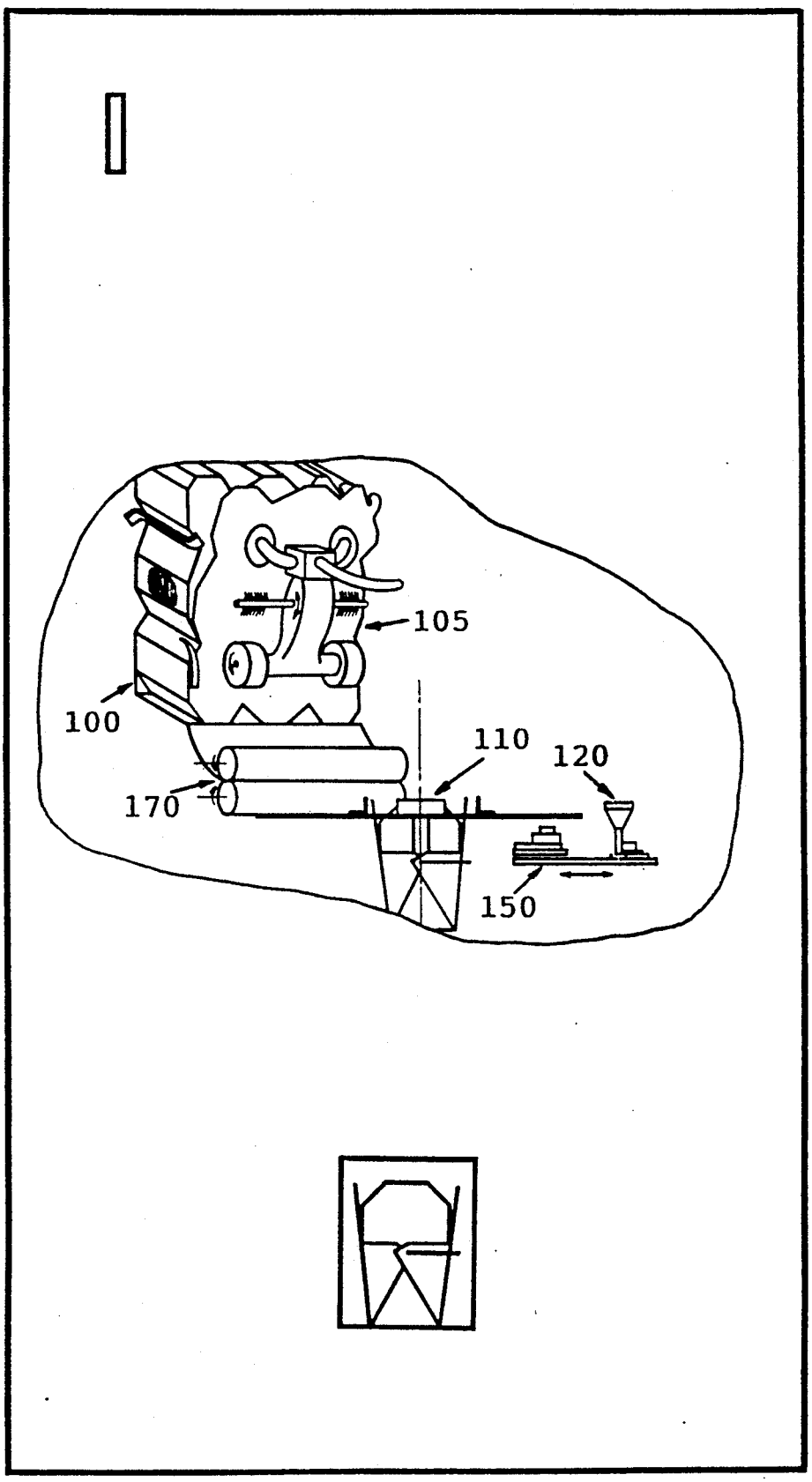
FIG. 7 is a front view of the vending cabinet with parts in section to illustrate location of the pail box mechanisms.
Figure 8:
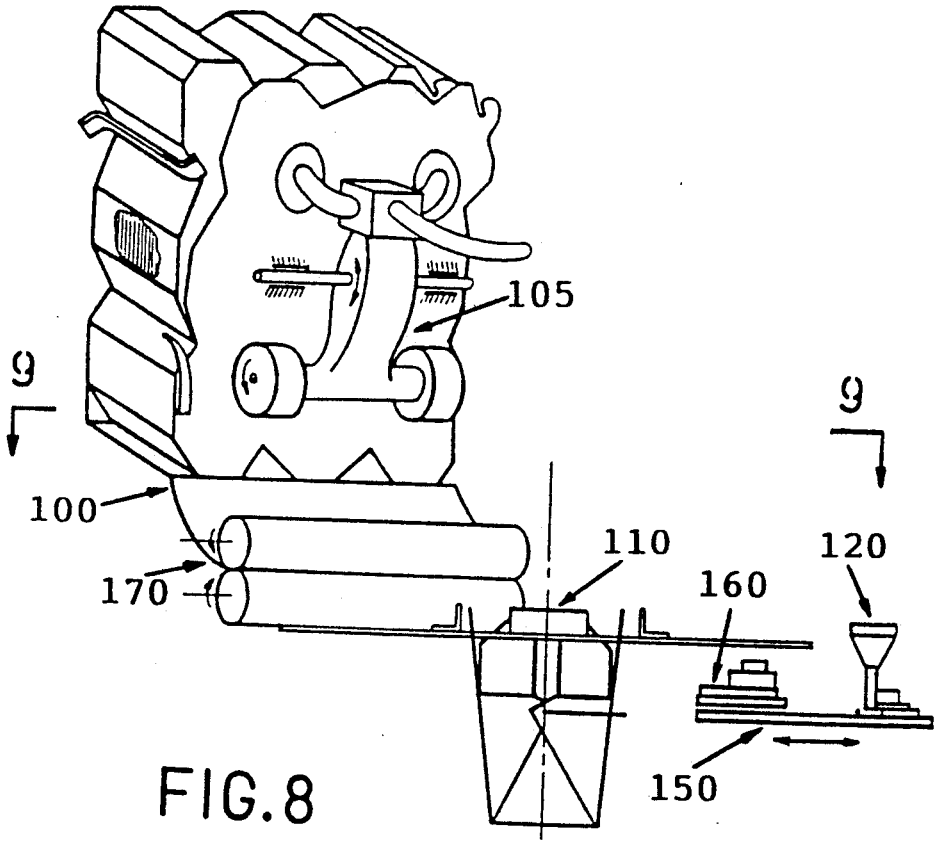
FIG. 8 is an enlarged fragmentary view of the pail box mechanisms for the vending cabinets.
Figure 9:
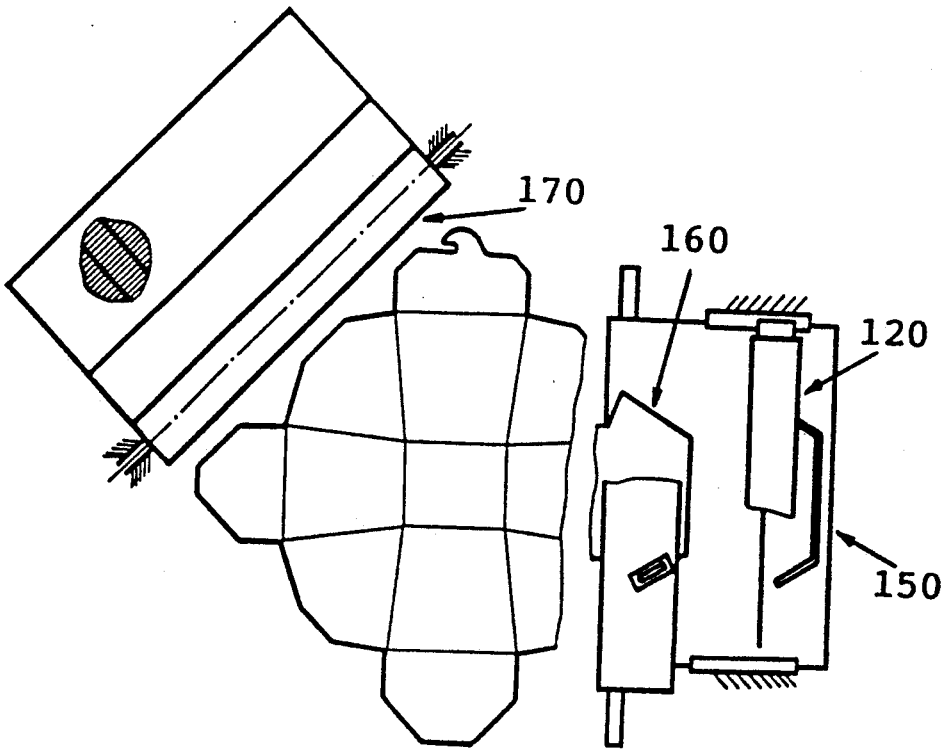
FIG. 9 is a fragmentary plane view taken along lines 9—9 of FIG. 8.

The operation of feeding the next wire blank, making a handle and attaching it to the folded box is as follows: By the vibration of the container 20 and the action of the gravity, the pieces of the wire blanks in the container fill the gauged groove 24. In this groove the lowest wire blank 18*a* is gripped by the magnets 37 which are inserted in the plate 25. After pusher 28 is power operated, the claws 27 pick up the lead wire blank 18*a* and push it through the outlet 31 and farther on the plate means 51 of the shuttle 50 where the wire blank 18*b* is gripped by magnets 53. When the plate means 51 with the wire blank 18*b* move down the forming punch 52 reach the bed die means 60, bent the legs 42 of the handle and press it to the bed die. In the next step, the punches 68 are moved and they bent the ends 43. At this point the process of making handle is done. Attaching this handle 18*c* to the folded box will be accomplished in the next cycle. In this cycle will be attached handle 18 made in the previous cycle. The process of fastening the handle 18*c* is as follows (see FIGS. 3-5). When the shuttle 50 is lifted in the upper position, the pusher 64 moves the handle 18*c* in the hollow 54 where it is gripped by the magnets 56. After that the shuttle moves down, clenches the folded box 70 and attaches the handle by clinchers 55.

Thus, in each cycle one handle is fastened to the folded box and one wire blank is bent to form a handle.

FIGS. 7 to 10 show a pail box apparatus according to another embodiment of the invention. The apparatus is mounted in the vending cabinet to automatically make pail boxes and pack them with goods.

The pail box apparatus for vending cabinets includes: a storage 100 for the paper blanks, means 105 for feeding the blanks to the position for folding, and a folding means 110 for folding boxes. All of these mechanisms are disclosed in the U.S. Pat. No 5,123,888 and therefore are not described in detail in this specification. Make handles and attach them to the folded boxes is provided by the same mechanisms which are described above for the automatic pail box machine. These mechanisms inclide a container means 120 for containing wire blanks and feeding them strictly one blank per cycle, a shuttle mechanism 150 for delivery at the same time of a handle made in the previous cycle and attaching it to the folded box and a following wire blank selected in the container means 120 for making a new handle which will be attached in the next cycle, and a bed die means 160 for bending handles. In addition, the vending cabinet may be equipped with a roller means 170 for continuous moving of the selected paper blanks to the position for folding and with a space 180 located inside of the piston 101 (FIG. 10) for disposition a certain structural features (not shown) of the vending equipment for filling the made box with goods when the piston 101 leaves the box.

Thus, the process of selection and folding a paper box in the vending cabinet is provided in accordance with the Pat. No. 5,123,888 for the automatic machine and the process of making and attaching a handle to the folded box—in accordance with the present invention described above. The only difference is that the shuttle means 150 for the pail box apparatus reciprocates in a horizontal plane.

Although particular embodiments of the present invention have been illustrated and described, it will be apparent to those skilled in the art that various changes and modifications can be made without departing from the spirit of the present invention, and it is intended to cover in the appended claims all such changes and modifications that fall within the scope of the present invention.

I claim:

1. An automatic machine for producing pail boxes from pre-made blanks of paper and straight pieces of wire blanks, comprising:

a frame that defines a box blank storage, a blank feeding means for feeding the box blanks from the storage to position for folding, a folding means for folding said box blanks into the form of a box, a receiver means for receiving made boxes, and drive machine means, wherein the improvement comprises:

A. a wire blank container for containing wire blanks and feeding the machine with one said wire blank per cycle, said wire blank container comprising: two walls, the bottom portions of which form a gauged groove for arranging the escaped said wire blanks just in one row, a plate rigidly attached to one of the walls and making with a second of the walls a gauged outlet passing through only one said wire blank per cycle, said plate having guides and flushly inserted magnets which grip the lead wire blank and hold it in straight position, a bracket with guides, a pusher slidable in said guides of the bracket and the guides of said plate, said pusher having two or more claws each with a step on its end for picking up and pushing said lead wire blank through said outlet, an elastic suspension for mounting said container to the frame of the machine, and a vibrator means for putting the container in a vibration condition;

B. a bed die means secured to said frame for bending handles, said bed die means comprising a bed die with a shape around which are bended said handles, two side brackets each having a guide, two punches slidable in said guides for bending the ends of said handles, a front bracket having two guides and a pusher with two claws slidable in said guides of said front bracket for pushing a made handle from said bed die;

C. a shuttle means for transfering said handle from said bed die means and attaching it to the folded box and in the same motion transfering said lead wire blank from said container and bending it on said bed die means to form another said handle, said shuttle means comprising a plate means reciprocated in guides of the machine in a vertical plane, said plate means including in a receiver portion thereof a forming punch for bending legs of said handle and a number of magnets flushly inserted in said plate means for gripping said wire blank received from said container, and in a shipping portion of said plate means there is a hollow with magnet edges for receiving and gripping said made handle which is pushed from said bed die means, and opening for releasing the fastened handle, and two clinching means for attaching handles to the folded boxes, said clinching means each having a clincher, slidable in the guides of said plate means, and a return spring.

2. The automatic machine of claim 1 wherein an angle between the guides in which are slided said shuttle means and said clinchers is oblique.

3. The automatic machine of claim 1 wherein said container means is supplied with guide means for centering said wire blanks when they are placed on said shuttle means.

4. An apparatus for automatically making pail boxes in vending cabinets from pre-made blanks of paper and straight pieces of wire blanks comprising:

a box blank storage, a box blank feeding means for feeding the box blanks from the storage to position for folding, and a folding means for folding said box blanks into the form of a box, wherein the improvment comprising:

A. a wire blank container for containing wire blanks and feeding the aparatus with one said wire blank per cycle, said wire blank container comprising: two walls, the bottom portions of which form a gauged groove for arranging the escaped said wire blanks just in one row, a plate rigidly attached to one of the walls and making with a second of the walls a gauged outlet for passing through only one said wire blank per cycle, said plate having guides and flushly inserted magnets which grip the lead wire blank and hold it in straight position, a bracket with guides, a pusher slidable in said guides of the bracket and the guides of said plate, said pusher having two or more claws each with a step on its end for picking up and pushing said lead wire blank through said outlet, an elastic suspension for mounting said container to the frame of the apparatus, and a vibrator means for putting the container in a vibration condition;

B. a bed die means secured to said frame for bending handles, said bed die means comprising a bed die with a shape around which are bended said handles, two side brackets each having a guide, two punches slidable in said guides for bending the ends of said handles, a front bracket having two guides and a pusher with two claws slidable in said guides of said front bracket for pushing a made handle from said bed die;

C. a shuttle means for transfering said handle from said bed die means and attaching it to the folded box and in the same motion transfering said lead wire blank from said container and bending it on said bed die means to form another said handle, said shuttle means comprising a plate means reciprocated in guides of the apparatus in a horizontal plane, said plate means including in a receiver portion thereof a forming punch for bending legs of said handle and a number of magnets flushly inserted in said plate means for gripping said wire blank received from said container, and in a shipping portion of said plate means there is a hollow with magnet edges for receiving and gripping said made handle which is pushed from said bed die means, an opening for releasing the fastened handle, and two clinching means for attaching handles to the folded boxes, said clinching means each having a clincher, slidable in the guides of said plate means, and a return spring.

* * * * *